US005524708A

United States Patent [19]

Isaacs

[11] Patent Number: 5,524,708

[45] Date of Patent: Jun. 11, 1996

[54] NON-METALLIC OIL WELL TUBING SYSTEM

[76] Inventor: Jonathan W. Isaacs, 410 17th St., Denver, Colo. 80202

[21] Appl. No.: 202,794

[22] Filed: Feb. 28, 1994

[51] Int. Cl.[6] ..... B22C 7/04

[52] U.S. Cl. ..... 166/243; 166/385; 285/140

[58] Field of Search ..... 285/140, 142, 285/143; 166/242, 383, 385, 243

[56] References Cited

U.S. PATENT DOCUMENTS

| | | | |
|---|---|---|---|
| 2,881,804 | 4/1959 | Bub et al. | 138/61 |
| 3,687,169 | 8/1972 | Reynard | 138/134 |
| 3,863,679 | 2/1975 | Young | 138/106 |
| 3,878,312 | 4/1975 | Bergh et al. | 174/9 F |
| 4,024,913 | 5/1977 | Grable | 166/172 |
| 4,139,024 | 2/1979 | Adorjan | 138/149 |
| 4,349,050 | 9/1982 | Bergstrom et al. | 138/147 |
| 4,516,608 | 5/1985 | Titus et al. | 138/140 |
| 4,628,966 | 12/1986 | Kanao | 138/122 |
| 4,640,362 | 2/1987 | Schellstede | 166/383 X |
| 4,679,755 | 7/1987 | Marsault et al. | 248/74.1 |
| 4,706,713 | 11/1987 | Sadamitsu et al. | 138/137 |
| 4,817,725 | 4/1989 | Jenkins | 166/383 X |
| 4,893,658 | 1/1990 | Kimura et al. | 138/109 |
| 4,999,389 | 3/1991 | Ariannejad | 523/440 |
| 5,007,462 | 4/1991 | Kanao | 138/154 |
| 5,018,583 | 5/1991 | Williams | 166/385 |
| 5,048,670 | 9/1991 | Crafton et al. | 198/643 |
| 5,109,889 | 5/1992 | Kanao | 138/173 |
| 5,179,140 | 1/1993 | Ariannejad | 523/440 |
| 5,184,649 | 2/1993 | Kanao | 138/122 |
| 5,213,379 | 5/1993 | Taniguchi et al. | 285/390 |
| 5,269,377 | 12/1993 | Martin | 166/385 |
| 5,332,049 | 7/1994 | Tew | 166/242 X |
| 5,348,097 | 9/1994 | Giannesini et al. | 166/385 |

*Primary Examiner*—Dave W. Arola

*Attorney, Agent, or Firm*—Rothgerber, Appel, Powers & Johnson

[57] ABSTRACT

A simple, efficient apparatus for deploying non-metallic tubing in an oil and gas well comprising a suspension system including one or more continuous support members attached to at least one bottom portion of the tubing and attached to the well head in a manner to alleviate the load which would otherwise be borne by the upper portion of the tubing. Additional guides or centralizers are used periodically along the length of the tubing to reduce helical wrapping of the suspension which could cause compressive forces resulting in tubing failure or collapse.

21 Claims, 6 Drawing Sheets

NON-METALLIC OIL WELL TUBING SYSTEM

BACKGROUND OF THE INVENTION

This invention relates generally to the field of hollow tubing for use in various oil and gas well applications. In particular, the invention relates to non-metallic tubing and especially to small diameter or thin-walled tubing.

Hollow tubing is used in various applications in the recovery of oil, gas, water and other liquids and gases from underground geological formations through "wells." For example, tubing is used as "casing" to form an exterior protection against collapse of the drilled hole. It is used as "production tubing" to convey the liquids or gases from the zone or zones from which they are extracted to the surface. Tubing is used in a variety of other oil well applications, such as, the connection of various machinery to surface or underground pumps.

Despite the long history of underground extraction of liquids and gases through wells, the predominant material utilized as tubing in such applications has been and still is steel or steel alloys. Although steel is expensive relative to other materials, it is commonly utilized because of its structural characteristics. Steel tubing is formed into sections that are threaded at each end to form secure connections. The threaded sections form a tube or "string" that may extend vertically underground for more than a mile placing severe tensile forces on the upper sections of the tubing. The lower sections of the tubing are subjected to horizontal compressive forces resulting from the elevated temperatures and pressures inherent in the subterranean environment. Steel tubing is generally capable of withstanding those stresses.

Nevertheless, steel tubing does have certain deficiencies. It corrodes. It can be very expensive. It is heavy, requiring massive surface equipment to install, support and maintain the tubing. The process of installing steel tubing in segments is laborious and time consuming. Flexible, continuous, i.e., "coiled," steel tubing is available in thin walled sizes for use in certain installations, such as those requiring a narrow diameter pipe. However, coiled steel tubing is extremely expensive. In at least some applications, i.e., where production is marginal, installation of coiled steel tubing is prohibitively expensive. In addition, steel is less effective than other materials, because it has a higher coefficient of friction, thereby requiring added force to produce oil and gas from subterranean depths through a long length of pipe.

For these reasons, there has been an interest in developing tubing made of materials other than steel for oil field applications. At one time, it was believed that plastics and other non-metallic materials could not be used, because they could not withstand the pressures, temperatures and/or tensile loads presented in bottom hole environments. Efforts to utilize non-metallic pipe in oil field applications have been reported in the patent literature. See, for example, U.S. Pat. Nos. 3,878,312, 4,024,913, 4,349,050, 4,516,608, 4,893,658, 4,999,389, 5,179,140, and 5,213,379, the more recent of which refer to the use of filled resin or fiber reinforced plastic pipe. These products have not been widely used in oil well applications and appear to suffer from several significant defects. For example, most of the materials are highly elastic. A number of the patents listed above attempt to address problems of cracking and deterioration of the threaded joints connecting the pipe sections. In addition, the materials by themselves do not provide substantial tensile strength to withstand the loads placed on the pipe by a long vertical pipe string. Although the substitute materials are generally lighter than steel, a long vertical column of tubing still presents a substantial weight stress, which upper segments of tubing are not capable of resisting. As a result, cracking and failure of the tubing will occur particularly upon any attempt to "pull," i.e., remove, the tubing from the well. These two major problems are not unrelated; the lack of tensile strength is consistent with high elasticity and a lack of structural integrity. Regardless of the reason, to the best of applicant's knowledge no economically viable alternative to steel tubing has been widely accepted for use in oil wells.

The invention presents a solution to the use of non-metallic tubing for oil well applications. As used herein, "non-metallic" refers to tubing that is not made of solid metal. However, the term can include plastics and other materials in which metal fragments, chips or fibers may be used as a filler or reinforcing agent.

OBJECTS OF THE INVENTION

It is an object of my invention to present a method and apparatus for utilizing non-metallic tubing in oil and gas wells to obtain the numerous advantages available from use of those materials.

It is a further object of the invention to present an inexpensive continuous tubing for use in such wells.

It is a further object of the invention to present a method and apparatus for successfully deploying tubing in oil and gas wells that is less expensive than currently available tubing and that is economically viable for many marginal wells.

These and other objects of the invention can be achieved utilizing the methods and apparatus described herein.

BRIEF DESCRIPTION OF THE DRAWINGS

The drawings, particularly FIG. 1, are illustrative only and are not drawn to scale, the proper dimensions for any particular application being apparent to one skilled in the art. All tubing, cables, fittings, centralizers and mandrels may need modification so they are effective in the environment of the particular oil or gas well in which they are deployed.

SUMMARY OF THE INVENTION

Figure 1:
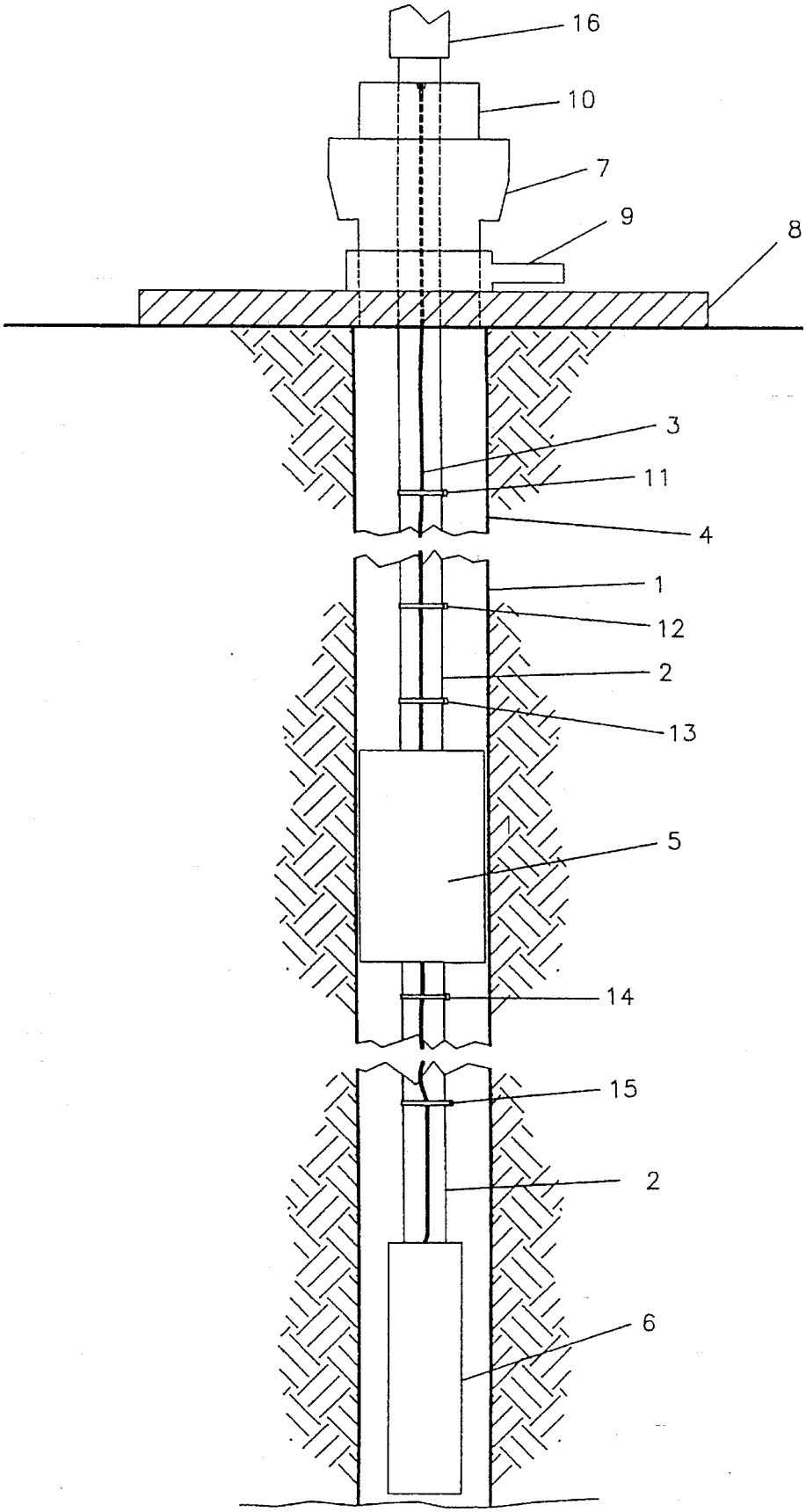
FIG. 1 is a schematic showing a system of continuous non-metallic tubing fabricated in accordance with one embodiment of this invention ad deployed in a well.

I have now discovered a simple, efficient apparatus for deploying non-metallic pipe in an oil well without incurring the deficiencies which have previously prevented the use of such materials. The apparatus comprises a suspension system including one or more continuous support members attached to at least one bottom portion of the tubing and connected to the well head, i.e., a surface platform or other surface equipment, in a manner to alleviate the load borne by the upper portions of the tubing. The load normally imposed on the tubing is transferred to the support member and ultimately to the well head. Centralizers may also be employed to properly locate the tubing in the well. The centralizers or other guide means may also be utilized periodically along the length of the tubing to prevent excessive helical wrapping of the suspension system around the tubing.

Reinforcement of non-metallic pipe materials is not new per se. See, for example, U.S. Pat. Nos. 2,881,804, 3,863,679, 4,628,966, 4,679,755, 5,007,462, 5,109,889 and 5,184,649. These patents, however, generally disclose systems for supporting tubing that is used in underground applications, e.g., sewer or water conduit, cable or other applications in which the tubing is deployed in an essentially horizontal position. The reinforcement is applied to resist compressive forces applied to the tubing in a direction radially from the axis. These forces emanate either from internal pressure of fluids or gases flowing through the tubing or from external forces, such as the weight of the earth above the tubing in situations in which the tubing is buried below ground. See, e.g., U.S. Pat. Nos. 3,687,169 and 4,706,713. These systems are not designed to provide support for tensile loads.

Non-metallic tubing installed in accordance with this invention has a number of advantages. First, the tubing is flexible and continuous, making it much more efficient to manufacture, transport and install. Indeed, it is considerably less expensive than steel tubing. In addition, it is lighter in weight than steel tubing, minimizing the size of the equipment necessary to install, deploy and maintain it in the well. It can be made from materials more resistant to corrosion than steel or steel alloys. It can also be made of materials, having a significantly lower coefficient of friction than steel, making it easier to produce oil and gas from wells which have pressure characteristics marginal or unacceptable for production with steel pipe. All of the foregoing factors translate into a more economical and efficient tubing for the production of oil and gas which may render marginal wells fit for the continued economic production of these hydrocarbons.

DESCRIPTION OF THE INVENTION AND THE PREFERRED EMBODIMENT

I have now discovered a simple, efficient apparatus for deploying non-metallic pipe in an oil well without incurring the deficiencies which have previously prevented the use of such materials. The apparatus comprises a suspension system including one or more continuous support members attached to at least one bottom portion of the tubing and connected to the well head, i.e., a surface platform or other surface equipment, in a manner to alleviate the load borne by the upper portions of the tubing. The load normally imposed on the tubing is transferred to the support member and ultimately to the well head. Centralizers may also be employed to properly locate the tubing in the well. The centralizers or other guide means may also be utilized periodically along the length of the tubing to prevent excessive helical wrapping of the suspension system around the tubing.

The present invention is not limited to any particular use of tubing in oil and gas wells. It may be used as production tubing or casing. It may also be used as a drilling string, particularly where air is employed. In addition, it can be used as a "chemical string" located outside the production tubing but inside the casing to deliver necessary chemicals, such as a corrosion retardant, to the exact depth where it is needed. It can also be used to "blow down" wells by inserting pressurized gas in a manner to remove residual liquids that impair production from wells of marginal bottom-hole pressure. This is an alternative to mechanical "swabbing".

Unless specifically noted herein, reference to an "oil well" means any well producing hydrocarbons in the form of liquids, i.e., oil, gases or both.

The invention may also be used in other applications, including subterranean wells. For example, it can be used as a liner in test wells for environmental sampling. It can be employed in other operations involving the transfer of liquids or gases out of or into the underground location through a well hole.

In particular, the invention is applicable to narrow bore wells in which there is a low bottom-hole pressure and/or producing rate, and conventional slim hole technology is cost prohibitive. As used herein, "slim hole" refers to installations with tubing strings having a diameter smaller than the conventional standard of two and three quarters' inch outside diameter. Certain marginal production environments can be re-claimed by utilizing this invention either inside conventional diameter steel production tubing or by itself.

In general, the present invention can be utilized in any situation in which tubing is arrayed in a vertical manner placing substantial tensile forces on the tubing itself. As used herein "vertical" means any deployment of tubing which is not purely horizontal resulting in the application of substantial tensile forces to higher, i.e., elevated, segments of tubing. Although the angle of incline of the tubing in the particular application may be slight, the tensile forces placed on the upper portions of the tubing can be considerable depending on the weight of the tubing material and the length of tubing.

One embodiment of the process of the present invention is shown schematically in FIG. 1, which depicts a typical arrangement of tubing and suspension system in accordance with this invention as utilized in an oil well. FIG. 1 depicts a well bore 1 for the production of oil and gas. Located in the well is metal tubing 4, which may be either casing or previously placed production tubing. Indeed, in one form of the present invention, the tubing of the present invention can be placed directly into the well bore, absent casing or production tubing.

Figure 3:
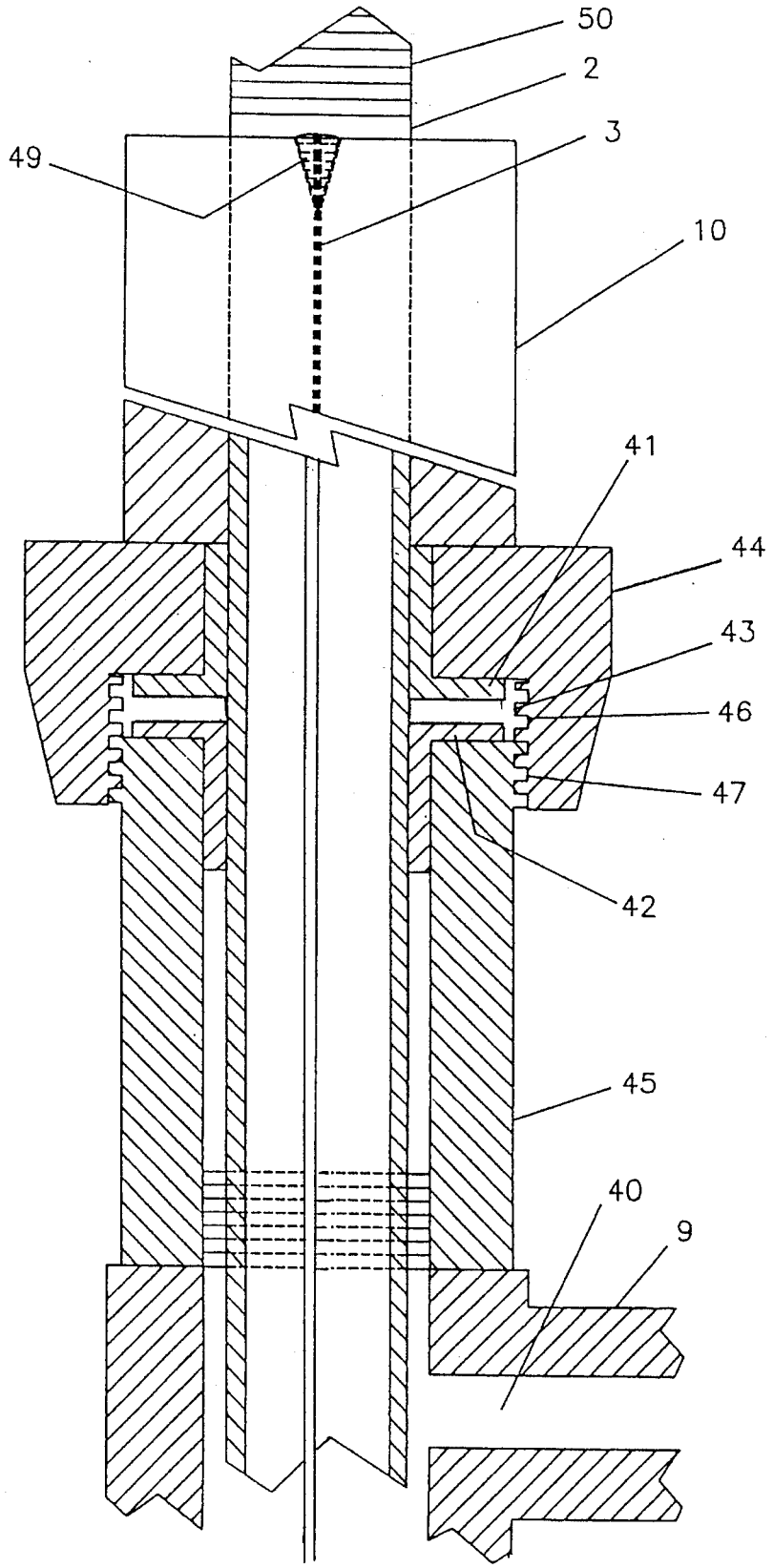
FIG. 3 depicts a typical arrangement for interconnecting the tubing and support system at the well head.

At the top of the well is a platform 8. On the platform is a "T" coupling 9, which supports packer 7. Located above packer 7 is an upper mount 10. The tubing 2 passes through T-connector 9, packer 7 and mount 10 and is connected with the Christmas tree 16, a portion of which is depicted in the figure. Oil and gas recovered from an underground formation passes upward through tube 2 and into the Christmas tree for proper distribution and processing. Also, as shown in FIG. 3, the support member is attached or "tied-off" at the mount 7.

The system of FIG. 1, includes tubing 2 made of a suitable non-metallic material. This can include various plastics either alone or reinforced with fibers or other materials, such as ground fiberglass, to provide additional strength. The particular material utilized should be selected for the specific application in which it will be employed. For example, the material should have a thermal stability appropriate for the depth of the hole and flexibility appropriate for the deviation of the bore hole. One such material is marketed under the trademark "Polypipe PE 3408 (black)," which is manufactured and sold by Poly Pipe Industries, Inc. located in Gainesville, Tex. Polypipe material cannot be used as tubing in oil wells of any significant depth absent the present invention without severe limitations.

Laminated pipes or pipes having a composite construction can also be used.

Preferably, tubing 2 is formed of a material sufficiently flexible, that it can be formed continuously and coiled or wound on a spool, much as electrical cable, for ease in shipping and installation. As used herein, the term "continuous" refers to tubing that is formed in an unbroken length for the particular well application. Because of the depth of some well applications and shipping limitations on the size of the wound tubing, in some applications it may be necessary to utilize two or more sections of tubing. Alternatively, the tubing of this invention can be formed in relatively short sections like steel pipe and connected together with mating threads at the ends of the pipe or by other means conventionally utilized in the art.

Regardless of whether the tubing is formed continuously or in sections which are joined together during installation, the non-metallic tubing utilized in the present invention should be capable of withstanding the stress of pressurized, high temperature fluids and gases passing through the tubing. However, the tubing may not be capable of doing so in the presence of vertical, i.e., tensile loads. These loads can ultimately result in failure of the tubing due to its own weight or in undue stretching resulting in tearing, cracking or other deformation or failure of the tubing. These destructive forces are particularly acute during installation or removal of the tubing.

The present invention resolves this problem by providing a suspension system that transfers the vertical, i.e., tensile, forces caused by the weight of the tubing to the suspension system. This is achieved by attaching to the tubing at least one support member of a material having sufficient tensile strength to support the tubing. The number of support members, the material of construction of those members and the means of attaching the support members to the tubing may vary within the spirit of my invention.

Typically, the support or suspension system is composed of a material having a high tensile strength formed into a member flexible enough to follow the direction of tubing 2 through the well hole. For example, metal or Kevlar (a synthetic material sold under that trademark by E. I. duPont and Company) formed into a flexible shape, such as a cable or wire, particularly a braided cable, could be employed. Although the support member can be configured in various shapes, preferably the support member does not extend around the entire external surface of the tubing, since such an arrangement could reduce the flexibility of the tubing making it impossible to manufacture, transport and install it as continuous, coiled tubing. Moreover, the primary purpose of the support is to provide tensile strength, rather than resistance to compressive forces placed radially on the tubing from internal or external pressures.

The tubing, cable and guides of the system, as described herein, can be attached to one another offsite and shipped wound as a unit to the well head, where it can be installed. The tubing can be prepared in the exact length needed in that particular well with appropriate threads being formed on the end of the tubing for connection to the Christmas tree or other surface distribution means. One or more of the various mandrels and centralizers can also be attached to the tubing at the appropriate positions corresponding to the depth in which they will be needed when the tubing is installed in the well.

Alternatively, the tubing, cable, guides, mandrels and centralizers are shipped separately to the well site. Again, the tubing may be pre-cut and prepared to the appropriate length. The cable and tubing are attached to the bottom mandrel which is placed in the well hole, where its' weight pulls the tubing and cable down the hole. The tubing and cable are run continuously and simultaneously from separate spools, stopping at appropriate lengths to attach any guides and centralizers at the appropriate depths and ultimately to attach the uppermost mount or mandrel.

In the embodiment depicted in FIG. 1, the tubing 2 is supported by a braided steel cable 3 on the exterior circumference of the tubing. As noted previously, the number of lines or cables may vary depending on the length of tubing and the tubing material and the type of support member employed. Although the placement of multiple support members, i.e., lines or cables, relative to the tubing may vary, generally to obtain maximum results, they should be deployed at equal spacing around the circumference of the tubing 1. For example, where two cables are utilized, they should be located 180 degrees apart on the circumference of the tubing. In the alternative, where additional strength is required, the support system can comprise a single larger steel line or cable.

To obtain the benefits of this invention, it is important that the support member or members be consistently taut along the length of the tubing and that they not be wound around the tubing. In multi-cable applications involving significant bends in the path of the tubing, the cable can be appropriately positioned and maintained in a taut position using centralizers, such as that shown in FIG. 4, to attach the cables to the tubing.

In order for the support member 3 to support tubing 1, it is necessary to attach the support member to the tubing at at least one lower position and that the support member be attached to the well head. The load caused by the weight of the installed tubing string is transferred to the support member; the support member transfers the load to the surface structure.

In the preferred embodiment of the invention depicted in FIG. 1, the tubing is attached to the support member at lower mandrel 6 and again at the top mount 10. Guide means, such as 11, 12, 13, 14 and 15 shown in FIG. 1, guide or align the support member 3 relative to the tubing 2, so that it is taut and straight and does not wrap around the tube. The guide means may permit horizontal movement of the support member relative to the tubing. In an alternative, the guide means may attach or connect the tubing and support together so that load on the tubing at that point is transferred to the support member. In this manner, the tubing and support members are attached at intervals. The size of the interval between attaching means depends upon the length of tubing and the material employed in it as well as the material employed in the support members. A distance of approximately 100 feet may be appropriate for typical oil well applications.

In the preferred embodiment of the invention, the support member 3 is attached at or near the base of the tubing. As depicted schematically in FIG. 1, this attachment can be made at mandrel 6. Because the tubing 2 and support member 3 are relatively light in weight, it is desirable to attach to the base of the tubing a mandrel of sufficient weight to pull the tubing and support member down the previously drilled hole. The outside diameter of mandrel 6 is sufficient to permit easy installation into the hole. It should also permit pressure equalization above and below the mandrel to prevent tubing failure due to collapse. The tubing and support system of the present invention can be employed inside casing or existing production tubing. The mandrel can be formed of a tubular piece of metal as depicted, for example, in FIGS. 2 and 2*a*.

Figure 2:
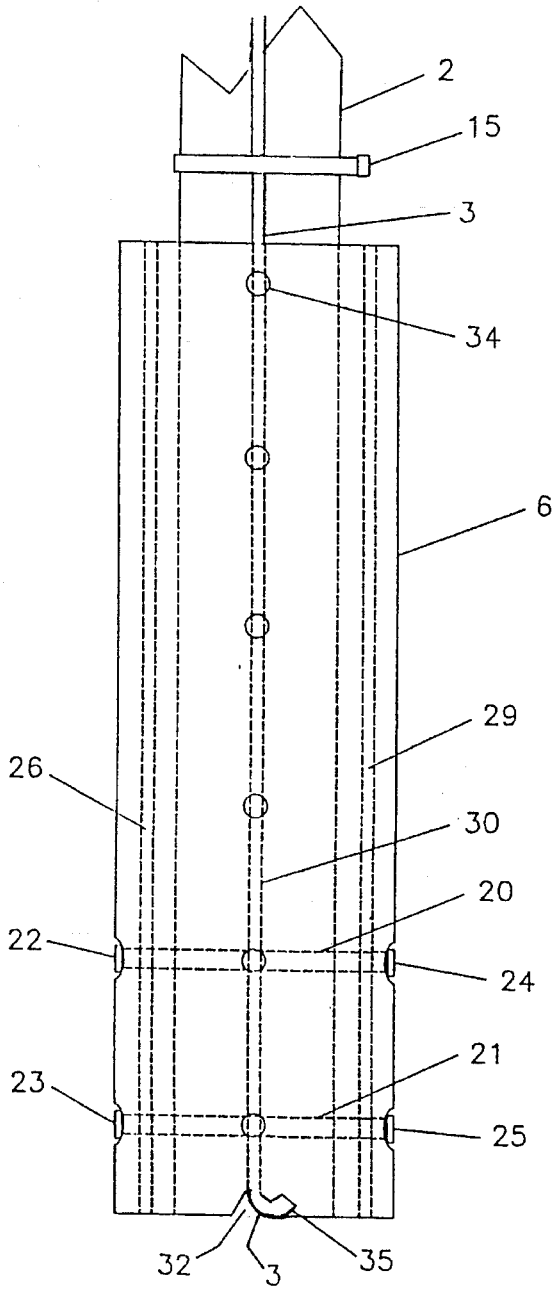
FIG. 2 depicts one form of mandrel that may be employed at the base of the tubing.

FIG. 2 is a detailed drawing showing the connection at the bottom end of the tubing 2 and cable 3. Mandrel 6 serves this purpose as well as the purpose of providing sufficient weight to facilitate running the cable and tubing into the well hole. The tubing 2 extends through a hole in the mandrel 6. Preferably the tubing does not extend beyond the lower edge of the mandrel, but is flush with the bottom of the mandrel or is recessed.

The tubing 2 is bolted to the mandrel 6. To accomplish this, connecting channels 20 and 21 extend radially from one side of the mandrel to the other. Bolts 22 and 23 pass through these channels and are fixed in place via nuts 24 and 25, respectively, to securely connect the tubing and mandrel. Both ends of channels 20 and 21 are recessed so that the heads of the bolts and the nuts are recessed below the outer surface of the mandrel so that they do not impede either downward or upward movement of the mandrel in the well bore.

Figure 2A:
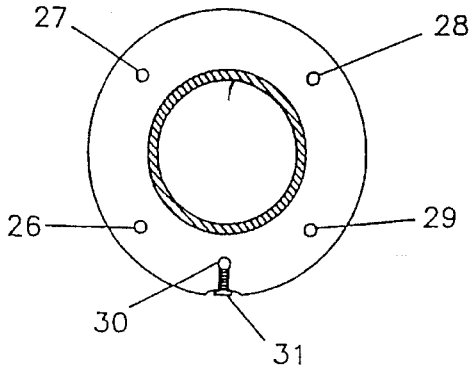
FIG. 2*a* is a top view of the same mandrel.

The support cable 3 is also fixed securely to mandrel 6, so that the load on the bottom of the tubing is transferred to the cable. Cable 3 extends into mandrel 6 through a hole 30 drilled through the mandrel. Channels, such as channel 34, extend from the exterior of the mandrel 6 to the cable channel 30. Cable tightening screw 31 extends through channel 34 to tension the cable 3 against the opposite wall of channel 30. Again, the ends of the channels 34 are recessed (as shown in FIG. 2*a*), so that the heads of the screws do not extend beyond the exterior surface of the mandrel in a manner which would impede the descent or ascent of the mandrel in the tubing 4. In addition, the lower end of the cable 3, extends out the bottom of the channel 30 in a recessed portion 32 of the mandrel. The end of the cable is bent backward into a hole 35 in the mandrel where it is also screwed into place. The screw means is not depicted in FIG. 2. Means of attachment other than those depicted in FIG. 2 could be used to form a secure connection between the support member 3 and mandrel 6.

The mandrel also contains a number of holes, such as 26–29 shown in FIG. 2, extending from the bottom to the top to permit equalization of the pressure above and below the mandrel.

The support member is attached to the well head to transfer the load from the bottom of the tubing to the surface structure. As depicted in FIGS. 1 and 3, support member 3 is also attached to tubing 2 at mount 10. Mount 10 is utilized to form a secure connection between the support member 3 and the well head and to support the tubing and support member in the well. One method of accomplishing this is shown in FIGS. 1 and 3.

Tubing 2 and cable 3 extend through the central channel in T-connector 9. The purpose of the T-connector is to permit communication via channel 40 with the area in the well between the external periphery of tubing 2 and the internal surface of casing 4. Access to this area is important for a number of reasons familiar to one skilled in the art. In applications where the pressure in the well is significant, it may be desirable to employ a "pop-off" valve with the T-connector to permit release of pressure from channel 40 to the atmosphere when the pressure exceeds a certain predetermined amount.

The tubing and support member also extend through packer 7, which comprises upper portion 44 and lower portion 45, which are screwed together via threads 46 and 47. Upper centralizer 41 and lower centralizer 42 are placed between the mating portions of the upper and lower packer sections to channel the tubing and support member properly in the well head. A gasket 43 separates the upper and lower centralizers so that they mate properly.

Located on top of the packer is a mount 10 which serves to connect the cable to the well head. The mount is supported by the packer. The tubing 2 and the cable 3 extend through the mount. The tubing continues on and is connected to the Christmas tree. The cable, however, terminates and is attached to the mount. Typically the cable is pulled taut and a metal, e.g., lead, ball is placed on the cable immediately adjacent to the surface of the mount where it extends through the mount. The ball serves to temporarily assist in keeping the cable taut but is generally not an acceptable means for bearing the load over a period of time. The free end of the cable 3 is then secured to the mount via a conically-shaped screw 49 that fits into a mated recess in the surface of the mount or by any number of other similar secure means.

In the preferred embodiment of the invention the tubing is also attached to the support member at at least one other location above the lower attachment and preferably near the top. In the embodiment shown in the accompanying figures this can be accomplished via mount 10, which may have connecting means such as those utilized in the bottom mandrel to connect the tubing to the mandrel as shown in FIG. 2. Thus, both the tubing and the support member transfer the loads applied to them to the mount 10.

In addition to the attachment of support members to the tubing at the top and the bottom, as noted previously, it is also desirable to have intermittent guide means along the length of the tubing. This can be accomplished, for example, by fittings 11, 12, 13, 14 and 15 as shown in FIG. 1. These fittings can comprise any means of guiding the support member along the tubing or attaching the support members and tubing together. For example, typical pipe or hose clamps can be used with the tubing and cable of the present invention.

In a preferred form of the invention the tubing is also installed with at least one "centralizer," i.e., a device for aligning the tubing in the well casing or hole. Such devices are particularly useful for preventing undue rubbing and abrasion between the exterior of the tubing and the casing or hole. They also prevent the cable from wrapping around the tubing in a helical manner which could cause excessive compressive forces and result in failure of the tubing. One form of a centralizer 5 which can also serve as an attachment between the tubing and the support members is depicted in FIG. 4.

Figure 4:
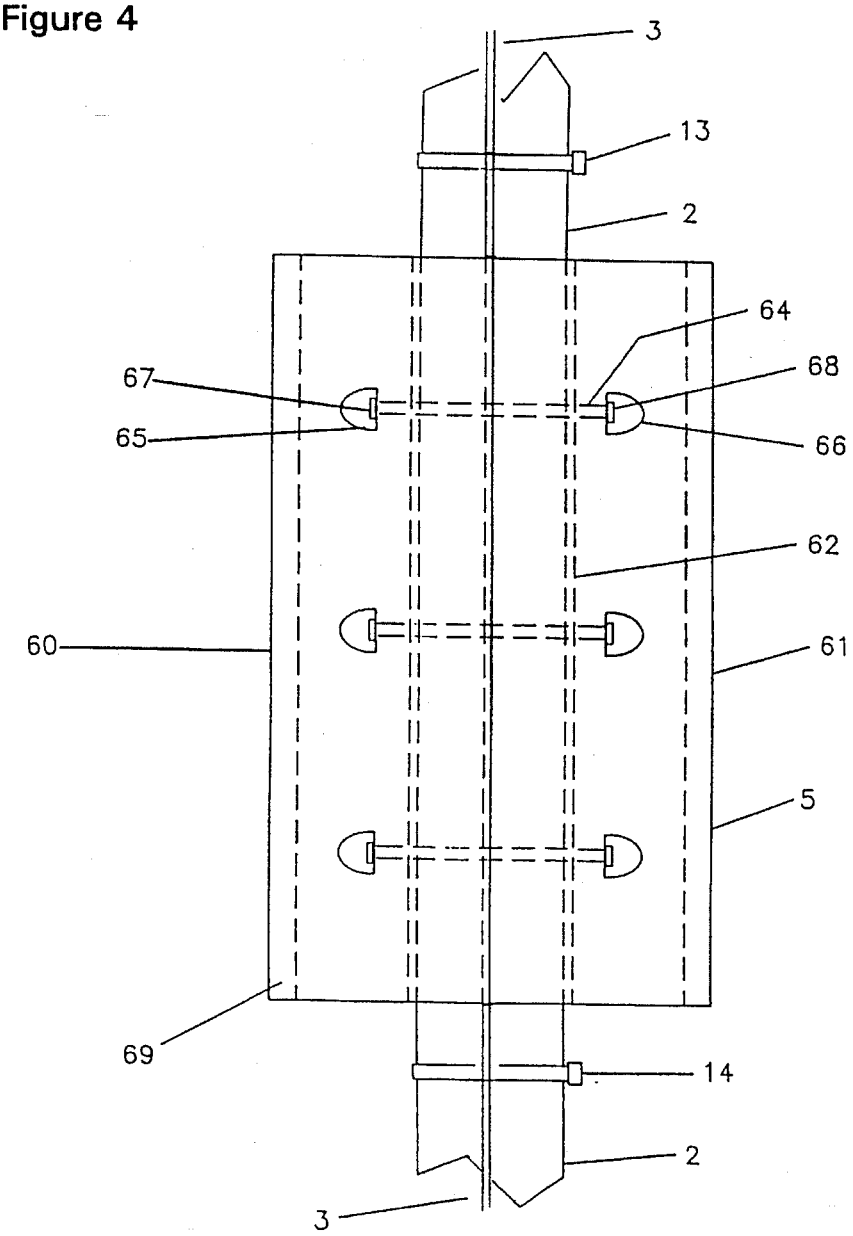
FIG. 4 shows one form of centralizer for properly locating the tubing in the well bore.
Figure 4A:
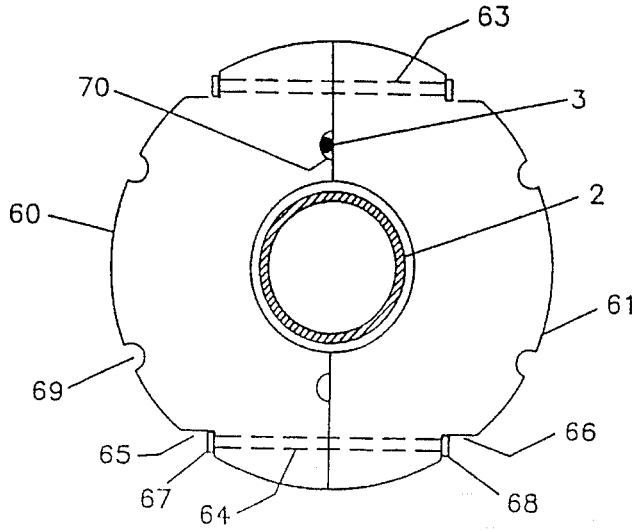

As shown in FIG. 4, centralizer 5 consists of two sections 60 and 61, which form a cylinder. The centralizer is formed in this manner so that it can be easily placed at the appropriate location on the tubing as it is installed in the well, without the necessity of running the entire length of tubing through the centralizer. The two sections are bolted together via channels, such as 63 and 64. As illustrated with respect to channel 64, a bolt 67 can be placed through that channel and secured in place via nut 68 to form a secure connection. Again, the channels, such as 65, are recessed at their ends 65 and 66 so that the head of the nut and the bolt do not extend beyond the outer surface of the centralizer, thereby restricting its insertion or removal from the well. The periphery of the centralizer contains cut-out portions, such as 67, which form channels from the top to bottom of the centralizer, thereby permitting pressure equalization above and below the centralizer.

The centralizer contains a hole 62 extending from the top to the bottom. The tubing 2 extends through this channel. Similarly, there is a parallel channel 70 through which the support member or cable runs. Channels 62 and 70 are sized to hold the tubing and cable in the middle of the well hole. The centralizer is connected to the cable to locate the centralizer at the proper depth. However, the tubing can move horizontally relative to the centralizer.

As noted previously, the tubing and support system can be formed integrally off-site and delivered to the well wound on a spool or can be formed together from multiple spools at the job site prior to or during insertion of the tubing and system into the well hole. Indeed, one of the principal advantages of the invention is to facilitate the running of the tubing into or out of the well hole. It is also advantageous in the installation or removal of tubing in horizontal wells, i.e., wells that have a horizontal off-shoot at some depth, particularly short radius horizontal wells.

Figure 5:
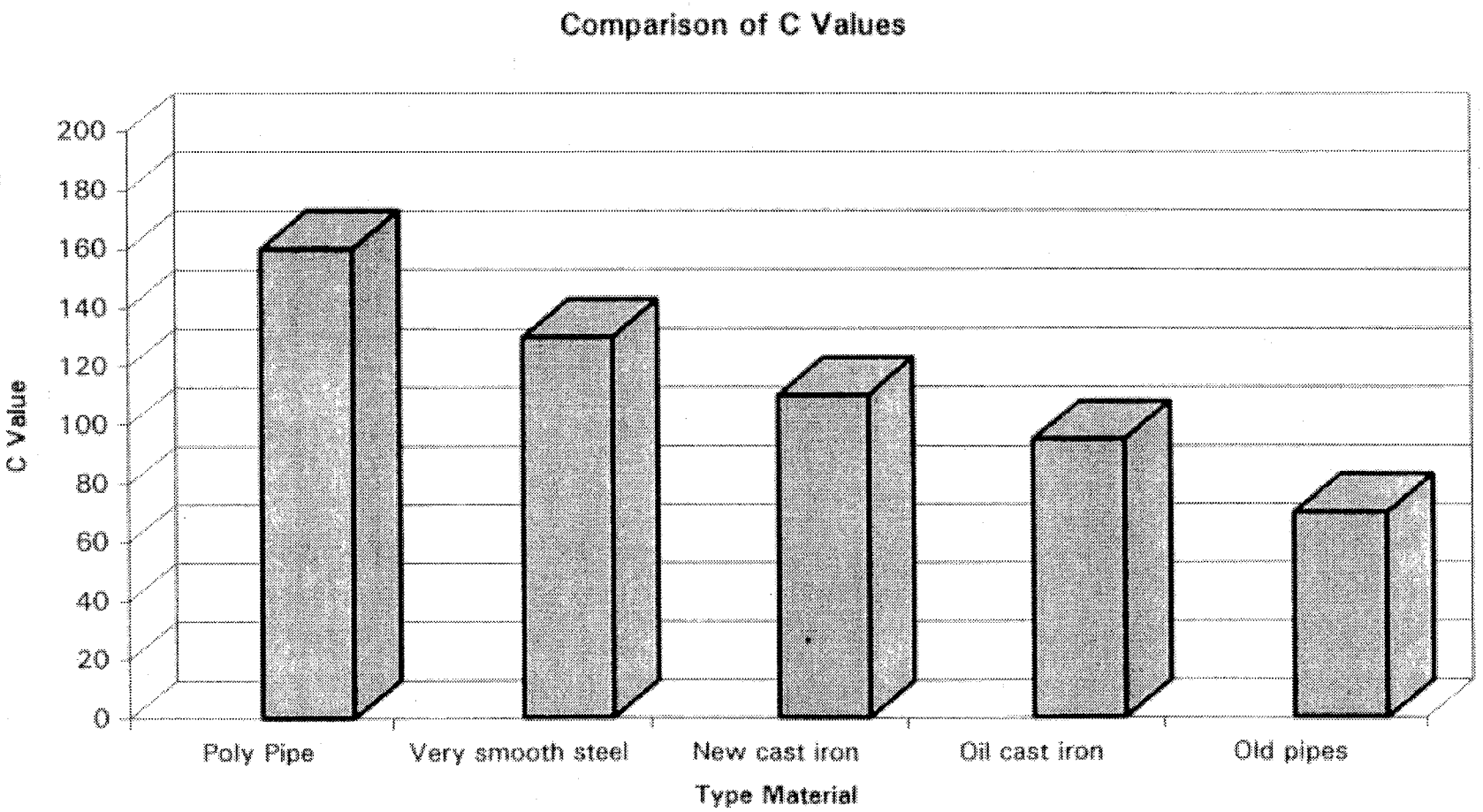
FIG. 5 depicts typical "C" values (i.e., a measure of roughness) for various materials some of which have previously been used in oil well tubing and for "Polypipe" tubing that might be used in accordance with the present invention.
Figure 6:
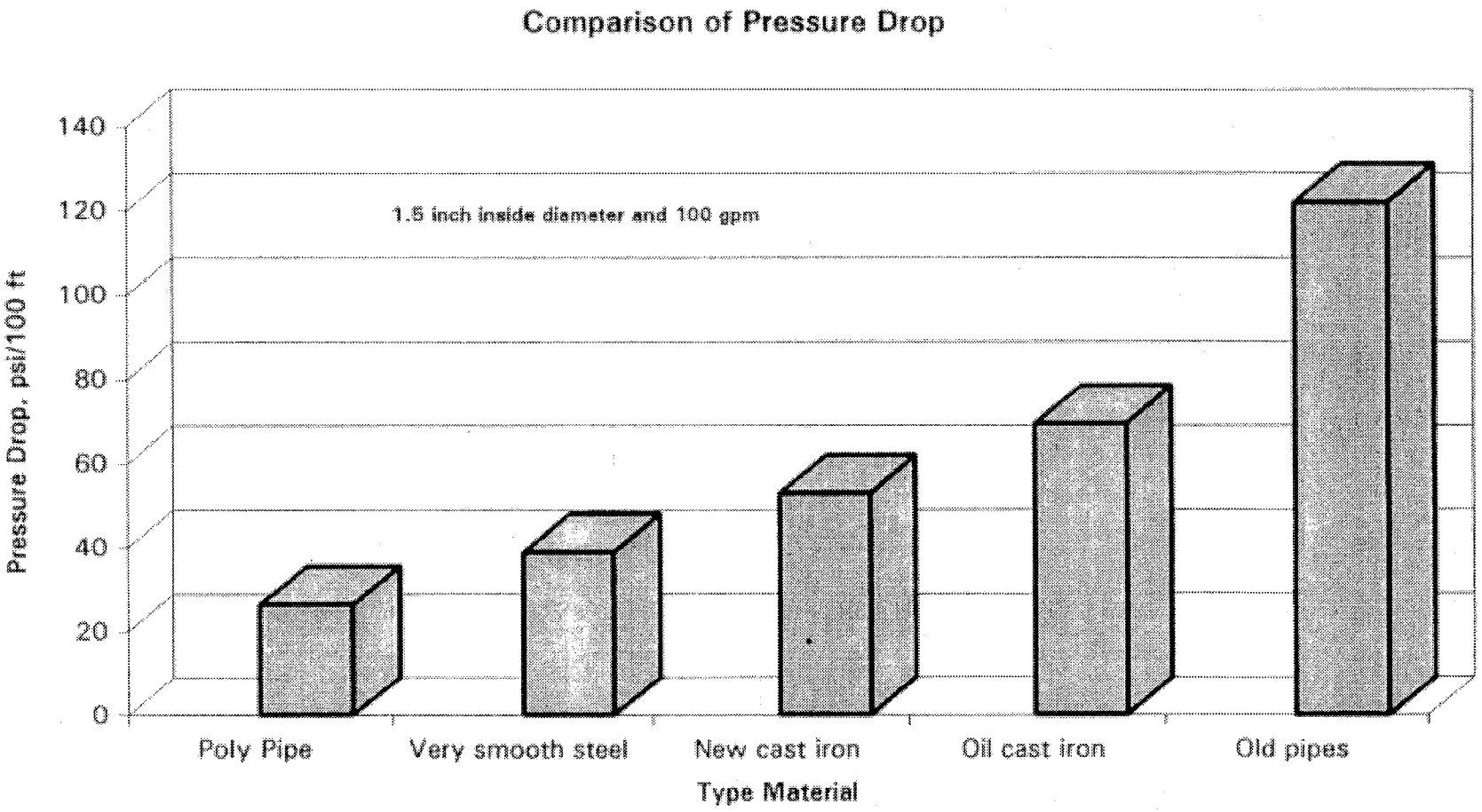
FIG. 6 shows the relative pressure drop of water passing through tubing made from the same materials shown in FIG. 5.

A significant benefit of the present invention is illustrated in FIGS. 5 and 6. FIG. 5 shows the "C" value for Polypipe PE 3408 (black) tubing and various quality steel and alloy pipes. "Old pipes" refers to steel tubing that has deteriorated due to internal corrosion, erosion, etc. and is not as smooth as new tubing. The "C" value is a measure of the roughness of the internal flow path presented by the tubing and represents the relative ease by which one material may move in contact with and relative to the surface material depicted on FIG. 5. Obviously, the Polypipe material has the highest "C" value and conversely would have the lowest coefficient of friction.

The advantages of using Polypipe material as tubing for the movement of fluids is depicted in FIG. 6. FIG. 6 shows the pressure drop over a uniform length of tubing made of different materials. The chart is based on the Hagan and Williams formula and assumes movement of water at 100 gallons per minute through horizontal tubing with an internal diameter of 1.5 inches. The chart shows the pressure drop of the water in pounds per square inch per 100 feet of tubing traversed by the water. Clearly, it takes less pressure to move the water through the Polypipe tubing than any of the other materials. Pressure drops in vertical or inclined pipes of the same materials would exhibit comparable differences. Although the absolute pressure drop varies depending on the particular application, the relative pressure drop would remain the same, i.e., Polypipe tubing would provide the least resistance. The use of Polypipe tubing in a well with an otherwise marginal bottom hole pressure could make it an economically viable well.

The novel apparatus and method of my invention is illustrated in the following example:

EXAMPLE

The device of the present invention is installed in a well which was drilled to a total depth of 5090 feet. The hole size was 7⅞ inch. Diamonium phosphate, an environmentally preferred material, was used as the drilling mud. The well had a deviation survey:

| DEPTH | DEVIATION DEGREES |
|---|---|
| 511 | ¼ |
| 1004 | ½ |
| 1621 | 1 |
| 2085 | 1½ |
| 2548 | 1¼ |
| 3010 | 1½ |
| 3501 | 1½ |
| 3968 | 1 |
| 4720 | 1½ |
| 5060 | 1½ |

The drill stem test indicated the recovery of natural gas at 151,000 cubic feet per day.

A total of 150 joints of 4½ inch, J-55 10.5# STC used casing was run into the well and set. Five centralizers were placed on collar #1, #3, #5, #7, and #10.

Inside the casing a continuous string of "Polypipe PE 3408 (black)" material with a diameter of 1.005 inch O.D., 0.75 inch I.D. was run. Simultaneously, a cable was run made of braided steel or "slick line." Clips were placed at 100 ft. intervals to align the tubing and cable to avoid wrapping. The cable was taut. The mandrel, centralizers and well head were generally as described in the drawings with this application.

The description and examples set forth herein are intended to illustrate representative embodiments of the invention. The claims which follow are not intended to be limited to the specific disclosed embodiments. The invention is susceptible to modification, variation and change without departing from the proper scope or fair meaning of the following claims.

I claim:

1. An apparatus for the deployment of non-metallic tubing in a well having a well head located on the surface of the well and having a vertical extent which places substantial tensile loads on the tubing comprising:

a length of non-metallic tubing extending at its top from the surface to its base in the well and which may be subject to failure due to the tensile loads; and a suspension system comprising:

at least one support member having sufficient tensile strength to support the tubing and extending along the length of the tubing;

first means for attaching the support member to the tubing at or near the base of the tubing; and second means for attaching the support member to the well head so that the support member thereby transfers tensile forces from the tubing to the well head.

2. The apparatus of claim 1 wherein the tubing is flexible.

3. The apparatus of claim 2 wherein the tubing is continuous.

4. The apparatus of claim 1 wherein the tubing is formed of Polypipe material.

5. The apparatus of claim 1 wherein the support member is located relative to the tubing using guide means located at intervals along the length of the tubing.

6. The apparatus of claim 1 wherein the support member is attached to the tubing using additional attaching means located at intervals along the length of the tubing.

7. The apparatus of claim 1 in which the first means for attaching the support member to the tubing is a mandrel having sufficient weight to pull the tubing down the well.

8. The apparatus of claim 1 in which the support member and tubing are positioned in the well by at least one centralizer placed along the length of the tubing.

9. An apparatus for the deployment of non-metallic tubing in a well having a well head located on the surface of the well and having a vertical extent which places substantial tensile loads on the tubing comprising:

a length of flexible, continuous non-metallic tubing extending at its top from the surface to its base in the well and which may be subject to failure due to the tensile loads;

a suspension system comprising:

at least one support member having sufficient tensile strength to support the tubing and extending along the length of the tubing;

first means for attaching the support member to the tubing at or near the base of the tubing;

second means for attaching the support member to the well head so that the support member thereby transfers tensile forces from the tubing to the well head; and at least one centralizer placed at a position along the length of tubing to locate the tubing and support member in the well.

10. The apparatus of claim 9 wherein the tubing is formed of Polypipe material.

11. The apparatus of claim 9 wherein the support member is located relative to the tubing using guide means located at intervals along the length of the tubing.

12. The apparatus of claim 9 wherein the support member is attached to the tubing using additional attaching means located at intervals along the length of the tubing.

13. The apparatus of claim 9 in which the first means for attaching the support member to the tubing is a mandrel having sufficient weight to pull the tubing down the well.

14. A method of producing hydrocarbons from an oil well having a well head located on the surface of the well and having a vertical extent which places substantial tensile loads on the tubing by flowing the hydrocarbons through a tubing system comprising:

a length of flexible, continuous non-metallic tubing extending at its top from the surface to its base in the well and which may be subject to failure due to the tensile loads;

a suspension system comprising:

at least one support member having sufficient tensile strength to support the tubing and extending along the length of the tubing;

first means for attaching the support member to the tubing at or near the base of the tubing;

second means for attaching the support member to the well head so that the support member thereby transfers tensile forces from the tubing to the well head; and at least one centralizer placed at a position along the length of tubing to locate the tubing and support member in the well.

15. The method of claim 14 wherein the tubing is formed of Polypipe material.

16. The method of claim 14 wherein the support member is located relative to the tubing using guide means located at intervals along the length of the tubing.

17. The method of claim 14 wherein the support member is attached to the tubing using additional attaching means located at intervals along the length of the tubing.

18. The method of claim 14 in which the first means for attaching the support member to the tubing is a mandrel having sufficient weight to pull the tubing down the well.

19. The method of claim 14 wherein the well has a relatively low bottom hole pressure or producing rate.

20. The method of claim 14 wherein the non-metallic tubing has a relatively low coefficient of friction inside.

21. The apparatus of claim 9 in which one end of the tubing is threaded for connection at the well head.

* * * * *